US005407617A

United States Patent [19]

Oppermann et al.

[11] Patent Number: 5,407,617

[45] Date of Patent: Apr. 18, 1995

[54] METHOD OF FORMING LATEX-, PVC- AND PLASTICIZER-FREE FOAMED FLOOR OR WALL COVERINGS

[75] Inventors: Horst Oppermann, Ralingen-Godendorf; Reinhold Blass, Ockfen; Joachim Duerkop, Pfullingen; Klaus Schmidt-Ott, Konz, all of Germany

[73] Assignee: Tarkett Pegulan AG, Frankenthal, Germany

[21] Appl. No.: 967,276

[22] Filed: Oct. 27, 1992

[30] Foreign Application Priority Data

Oct. 31, 1991 [DE] Germany ..... 41 35 937.2

[51] Int. Cl.[6] ..... B29C 67/22

[52] U.S. Cl. ..... 264/46.4; 264/54; 264/113; 264/126; 264/132; 156/79

[58] Field of Search ..... 264/52, 46.4, 54, 132, 264/126, 113; 156/79

[56] References Cited

U.S. PATENT DOCUMENTS

| | | | |
|---|---|---|---|
| 3,037,897 | 6/1962 | Pelley | 156/78 |
| 3,598,671 | 8/1971 | Wortman | 156/79 |
| 3,682,730 | 8/1972 | Haase | 156/79 |
| 3,836,624 | 9/1974 | Ferris | 264/52 |
| 3,844,814 | 10/1974 | Bettoli et al. | 264/52 |
| 4,093,686 | 6/1978 | Briston et al. | 156/79 |
| 4,143,187 | 3/1979 | Pilgrim et al. | 264/174 |
| 4,278,483 | 7/1981 | Mansolillo | 156/79 |
| 4,464,432 | 8/1984 | Dost et al. | 427/246 |
| 4,836,871 | 6/1989 | Kato | 156/79 |

FOREIGN PATENT DOCUMENTS

| | | | |
|---|---|---|---|
| 2128964 | 12/1971 | Germany . | |
| 2533407 | 2/1976 | Germany . | |
| 2450948 | 5/1976 | Germany . | |
| 2621195 | 11/1977 | Germany . | |
| 3422682 | 1/1987 | Germany . | |
| 64-031685 | 2/1989 | Japan | 156/79 |
| 4249143 | 9/1992 | Japan | 156/79 |
| 1420624 | 1/1976 | United Kingdom . | |
| 2191209 | 12/1987 | United Kingdom . | |

OTHER PUBLICATIONS

"Manufacture Of Carpet Backings", Chemical Abstracts, vol. 107, No. 24, Abstract No. 218897x Dec. 1987.

*Primary Examiner*—Allan R. Kuhns
*Attorney, Agent, or Firm*—Foley & Lardner

[57] ABSTRACT

A process for manufacturing latex-, PVC- and plasticizer-free textile or plastic floor or wall coverings, which contain a foamed layer, in which a powder mixture containing:

(1) 100 parts by weight of a thermoplastic polymer;
(2) 0–100 parts by weight of fillers;
(3) 0.5–7 parts by weight of blowing agents; and
(4) 0–30 parts by weight of additives;

is scattered onto a backing layer, melted at a temperature within the range of from about 70° to about 110° C. smoothed between smoothing rolls and foamed at a temperature within the range of from about 120° to about 200° C.

3 Claims, 1 Drawing Sheet

METHOD OF FORMING LATEX-, PVC- AND PLASTICIZER-FREE FOAMED FLOOR OR WALL COVERINGS

BACKGROUND OF THE INVENTION

1. Field of the Invention

The present invention relates to the manufacture of latex-, PVC- and plasticizer-free floor or wall coverings having chemically foamed and, if desired, structured foam layers.

2. Background

Textile floor or wall coverings having a foamed layer of a natural or synthetic latex- on the reverse side and PVC-plastic coverings are in widespread use today due to their versatile decorative application. These floor or wall coverings also are popular because of their simple installation and low cost.

The possibility of providing the coverings with soft, foamed backings which significantly contribute to footstep sound insulation and improve walking comfort, has ensured the continued use of such materials. Furthermore, the foaming permits the generation of surface structures either by foaming in suitable molds or on embossing rolls, or by partial chemical activation or inhibition of the foam formation. In the case of textile coverings, only mechanical foaming by the injection of air into the latex- compound is carried out commercially since the chemical foaming requires high temperatures. Such high temperatures are known to damage the textile nap.

In order to avoid joints during installation, floor coverings typically are manufactured in endless webs with a width of up to 4 or 5 meters, which considerably limits the possibilities from the point of view of both the material and the processing techniques.

Textile floor coverings generally are manufactured either by the tufting process or from needled nonwoven fabrics, which are consolidated on the reverse side with a styrene-butadiene or other latex- compound. The fabrics then are coated with a mechanically foamed synthetic or natural latex- layer and fixed by drying. The textile layer comprises predominantly polyamide, polypropylene or polyester fibers, which can no longer be separated from the latex- layers. One disadvantage is that the composite layers cannot be recycled.

Plastic floor coverings have hitherto generally been manufactured from latex- dispersions or PVC- plastisols by a spreading process on a substrate of woven fabric or release paper, and subsequently cured. The plastisols consist of PVC- particles, plasticizers and conventional additives and fillers, which sinter together to produce a matrix upon drying under heat. By adding chemical foaming agents, the layer can additionally be thermally foamed. It typically is possible to achieve an additional structuring by applying blowing agent activators or deactivators to certain regions. It is naturally also possible, by applying several layers of different composition, to vary the properties of the floor covering to a wide degree.

Although polyamide and polyesters are excellent materials for textile coverings and PVC- is an excellent material from the point of view of its cost and its properties, ecological aspects, such as the possibility of recycling the products, avoidance of solvents and halogen-containing components must be accounted for. Therefore, there exists a need for processes for manufacturing coverings which are free of latex-, PVC- and plasticizer.

For economic and technical reasons, however, it is necessary to retain the previous manufacturing widths and, if possible, also the existing manufacturing equipment. Furthermore the floor covering should also consist of different layers, one or more of which are chemically foamed and, if desired, partially structured by activating or deactivating the foaming process.

It is known from the so-called Furukawa process to prepare cross linked polyethylene foams by extruding polyethylene, azodicarbonamide as a blowing agent and dicumene peroxide as a crosslinking agent with the aid of an extruder, with downstream sheet die to produce a matrix in the form of a film or an unfoamed sheet. It is necessary for this extrusion process to take place at a temperature at which the polyethylene is liquid, but at which the cross linking agent has not yet decomposed. The free radical decomposition of the peroxide is initiated and the polyethylene cross linked with simultaneous chemical decomposition of the blowing agent and foaming of the matrix either after interim storage or by direct introduction of the matrix into a foaming oven. This process currently permits foams with densities between 30 and 175 kg/m$^3$ and thicknesses between 5 and 15 mm to be manufactured. The width of these foams, however, is limited to about 2 m, since sheet dies of greater size cannot be manufactured. Therefore, economical manufacture of conventional floor coverings is not possible by this process.

It further is known that moldable foams can be manufactured from ethylene-vinyl acetate copolymers (EVA) or mixtures of EVA with polyethylene (PE) by mixing polymers, fillers, activators, foaming agents and, if required, cross linking agents at temperatures of from 90° to 100° C. At this temperature, the polymer is already soft or liquid, but the additives remain chemically stable. Subsequent to mixing at this temperature the mixture is granulated. The granules are subsequently introduced into molds, foamed by heating and removed from the mold after recooling. Relatively small, even complicated moldings can be manufactured satisfactorily in this manner. Examples of moldings which can be manufactured are shoe soles, balls, gaskets, mats, masks etc. The production of continuous webs with a width of 4 to 5 meters, as are necessary for floor coverings, is not possible by this process.

It further is known to produce unplasticized polyurethane foams by mechanical foaming of the components with the injection of air, but the foaming in this case cannot be chemically inhibited and thus no structure can be generated.

SUMMARY OF THE INVENTION

It is an object of the present invention to produce a textile which can readily be recycled.

It is another object of the invention to produce a textile having a foamed layer which can be manufactured using existing machinery. It is another object of the invention to produce a textile having a conventional width of about 4 to about 5 meters.

It is another object to produce a mixture which can be added to textile or plastic floor or wall coverings as a foaming layer to provide floor or wall coverings which are recyclable, and which can be processed using known processing equipment.

It is further an object of the invention to provide a process for producing a textile or plastic floor or wall covering having these desired properties.

In accomplishing the foregoing objectives, there is provided, in accordance with one aspect of the present invention, a process for manufacturing a latex-, PVC- and plasticizer-free textile or plastic floor or wall covering which contains a foamed layer. Such floor or wall coverings can be manufactured by scattering a powder mixture having:

(i) 100 parts by weight of a thermoplastic polymer;
(ii) 0–100 parts by weight of one or more inorganic fillers;
(iii) 0.5–7 parts by weight of one or more blowing agents; and
(iv) 0–30 parts by weight of one or more organic additives onto a backing layer. The mixture then is melted on the backing layer at a temperature within the range of from about 70° to about 110° C. The floor or wall covering then is smoothed between smoothing rollers, and foamed at a temperature within the range of from about 120° to about 200° C.

In accordance with another aspect of the present invention there is provided a mixture for use in a process for manufacturing a latex-, PVC- and plasticizer-free textile or plastic floor or wall covering. The mixture is made of:

(i) 100 parts by weight of a thermoplastic polymer;
(ii) 0–100 parts by weight of one or more inorganic fillers;
(iii) 0.5–7 parts by weight of one or more blowing agents; and
(iv) 0–30 parts by weight of one or more organic additives The thermoplastic polymer has a melt flow index (MFI 190° C./2.16) within the range of from about 2 to about 40, and a crystallite melting point within the range of from about 70° to about 110° C.

DETAILED DESCRIPTION OF THE PREFERRED EMBODIMENTS

Figure 1:
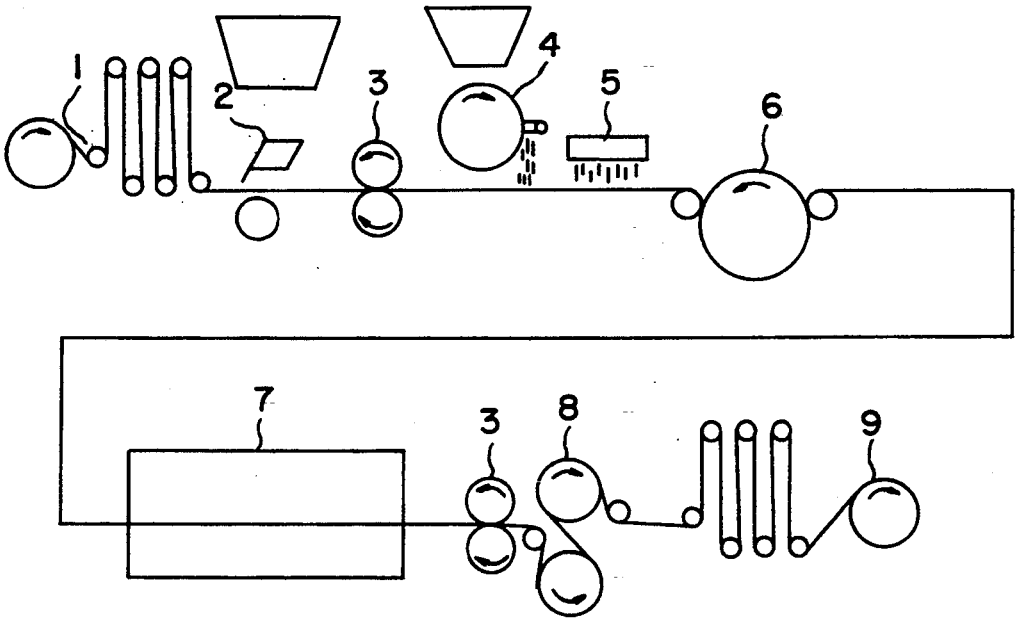
FIG. 1 illustrates a powder scattering and coating machine used in the process described in Example 4.

Latex-, PVC- and plasticizer-free floor or wall coverings of the present invention can be manufactured by scattering a powder mixture comprising a thermoplastic polymer, fillers, blowing agents and additives onto a backing layer disposed below a foam layer. The powder mixture then is melted onto the floor or wall covering material at a temperature within the range of about 70° to about 110° C., smoothed between smoothing rolls and foamed at a temperature within the range of foam about 120° to about 200° C. The textile or plastic floor or wall coverings can be manufactured at a width of about 4 to about 5 meters using commercially available processing equipment.

Throughout the specification and claims, the phrase "latex-, PVC- and plasticizer-free" is meant to include floor or wall coverings having up to about 1 wt. % latex-, PVC- or plasticizer based on the total weight of the covering. Preferably, the floor or wall covering has no latex-, PVC- or plasticizer. The term latex shall include natural or synthetic rubber or or caoutchouc.

It is extremely surprising that the mixtures made in accordance with the invention can be uniformly distributed over widths of about 4 to about 5 meters using conventional powder scattering machines. In accordance with the present invention, upon subsequent passage of the textile or plastic floor or wall coverings through the drying oven, a homogeneous uniformly thick foam layer results. Multiple layers also can be conveniently prepared by scattering a second powder layer onto a first solidified and, if required, leveled layer, and again drying or gelling the layer. Coloring of the layer is made possible by interim printing of the color pattern, and structuring is made possible by printing an activator or deactivator onto the layer.

The polymers which can be used in accordance with the invention cover a wide range of thermoplastic products. The most important parameter of the thermoplastic product is the melt flow index (MFI 190°/2.16) ASTM-No. 1268-62. It has been found that at melt flow indices below 2.5 and over 40, the melt viscosity, which is too high or low respectively, generally no longer permit a sufficient cell structure of the foam. A melt flow index within the range of about 10 to 20 is preferred.

The crystallite melting point of the polymers should be below the decomposition range of the blowing agent mixture, but not so low that the foam begins to flow, e.g., under intense solar irradiation or weighting. Crystallite melting points in the range of from about 70° to about 110° are highly suitable in this respect. Very low melting points of the polymers, however, can be induced by subsequent crosslinking, for example, by the addition of peroxide or by treatment with high-energy radiation. Suitable polymers having these desirable properties include copolymers of ethylene and vinyl acetate, polyethylene, polypropylene, polymers and copolymers of vinyl acetate, methyl methacrylate, ethylene acrylate, and maleic anhydride.

The polymers typically are ground from commercial granules to a maximum grain size of about 400 to about 600 μm, and preferably are within the range of from about 10 to about 400 μm. In this form, the polymers then are mixed with the other components.

Possible additives include all of those which also are included in conventional foam mixtures. Examples of additives include, but are not limited to, inorganic fillers such as chalk, silicates, magnesium hydroxide or aluminum hydroxide, barite, silica, glass powder, carbon black, titanium dioxide, or other pigments which simultaneously modify the transparency of the foam. Suitable organic additives include wood or cork flour, and thermally-resistant plastics such as polyurethanes. These organic additives typically are added to the mixture as fine powders with grain sizes of about 10 to about 500 μm, with the fillers being added to the mixture in quantities of 5 to about 50 wt. %, depending on the product.

The blowing agents used for the foam layers can be conventional blowing agents typically used for plastisols such as azodicarbonamide, oxybisbenzenesulfonylhydrazide, azobisisobutyronitrile, toluenesulfonylhydrazide, and the like. Preferably, azodicarbonamide is used. The decomposition temperature of azodicarbonamide can be reduced from approximately 200° C. to temperatures as low as 120° C. by the addition of activators such as zinc oxide, zinc octanoate and other known activators. The appropriate foaming temperature can readily be adapted in this manner to the respective plastics to be foamed and the viscosity thereof. The blowing agents typically are added to the mixture as a fine powder (preferably a grain size of 2 to 12 μm) or as a batch, such as ground with paraffin or antistatic agents, in quantities of about 0.5 to about 10 wt. %.

The mixture used to form the foam layer typically is ground to form a powder mixture. The average grain size of the powder mixture generally is within the range of from about 1 to about 600 μm. Preferably, the average grain size of the powder mixture is within the range of from about 5 to about 500 μm, and more preferably within the range of from about 10 to about 400 μm.

As deactivators for situations in which foaming is not desired, known deactivators for such mixtures can be used. Preferably, trimellitic anhydride, a triazole such as benzotriazole or thiourea is used. In contrast to the solvent containing pastes which permit diffusion of the deactivators into the foamable layer, the deactivator of the present invention should be printed-on together with a transfer agent. Suitable transfer agents are liquid paraffins, liquid antistatic agents or cross-linkable derivatives of methacrylic acid. The deactivators should be employed in a quantity of approximately 0.5 to about 2 wt. %, relative to the weight of the foam layer to be structured.

In addition, peroxides for crosslinking the foam and for improving the thermal resistance of the polymers both during processing and in subsequent use can be added to the mixture. Other suitable auxiliaries include bactericides, antistatic agents, antioxidants etc., all of which are conventional in latex- and plastics processing.

Those skilled in the art are capable of using commercially available manufacturing equipment to carry out the process of the present invention. Moreover, skilled practitioners are cognizant of the methods employed in mixing the aforementioned compositions and adding the compositions to textile or plastic floor or wall coverings.

The invention is explained in greater detail with reference to the following examples.

FORMULATION EXAMPLES

EXAMPLE 1

Formulation for smooth foams

| | |
|---|---|
| Ethylene vinyl acetate (EVA) (acetate content 28%) | 1000 kg |
| Aluminum hydroxide | 200 kg |
| Blowing agent mixture (azodiacarbonamide/zinc oxide) | 35 kg |
| Zinc octanoate | 10 kg |
| Antistatic agent (Irgastrat ® 51, available from Ciba Geigy) | 10 kg |
| Titanium dioxide | 10 kg |
| Peroxide | 50 kg |

EXAMPLE 2

Formulation for foam which can be structured

| | |
|---|---|
| EVA (acetate content 28%) | 1000 kg |
| Azodicarbonamide | 20 kg |
| Zinc oxide | 75 kg |
| Zinc octanoate | 5 kg |
| Antistatic agent (Irgastat ® 51) | 60 kg |
| Titanium dioxide | 10 kg |
| Peroxide | 50 kg |

EXAMPLE 3

Formulation for foam which can be structured

| | |
|---|---|
| EVA (acetate content 28%) | 1000 kg |
| Azodicarbonamide | 20 kg |
| Zinc oxide mixture | 75 kg |
| Zinc octanoate | 5 kg |
| Antistatic agent (Irgastat ® 51) | 10 kg |
| Titanium dioxide | 10 kg |
| Peroxide | 50 kg |
| Triethylene glycol dimethacrylate | 140 kg |

PROCESS EXAMPLES

EXAMPLE 4

This example describes the preparation of foam-containing, textile or elastic floor coverings with scattered, chemically foamed EVA dry blends.

The precursor is a conventional tufting covering without a consolidated backing, a needle felt covering with only fiber impregnation, or a heterogeneous, foam-structured elastic floor covering, which is pre-produced on production machines suitable for this purpose and well known to those skilled in the art. A commercially available powder scattering machine is used as additional equipment in the conventional reverse-side treatment and coating systems; the complete system is shown schematically in FIG. 1. The backing material, textile covering or pre-fabricated heterogeneous elastic covering, is fed continuously to the system by a roll take-off system 1 and storage-feed system. In a first application unit 2, a fixing or primer coat for sealing the substrate surface is applied by a conventional coating device (not illustrated) and, if necessary, heated by baking (circulating air duct or radiator) and smoothed by a smoothing device 3.

In a second application unit 4, the EVA dry blend described in Example 1 is applied by a powder scattering machine and subsequently fused in an infrared radiator station 5. At this point, the EVA dry blend described in Example 1 has not yet been chemically foamed or crosslinked.

The fused surface can additionally be smoothed via a smoothing drum 6 and consolidated. The sheet structure thus obtained is heated in a drying/gelling oven 7 to approximately 120° to 200° C., causing the EVA powder to foam and crosslink by reaction of the peroxides present therein. This is followed by a further smoothing unit 3, a cooling zone 8 and accumulator unit and roll-up system 9. If required, the necessary finished goods inspection of the floor covering web can take place directly in the system. The material then is cut to length and rolled up on individual rolls before passing to the finished goods store.

EXAMPLE 5

This example describes the production of foam-containing floor coverings with scattered, chemically foamed and structured EVA dry blends.

Figure 2:
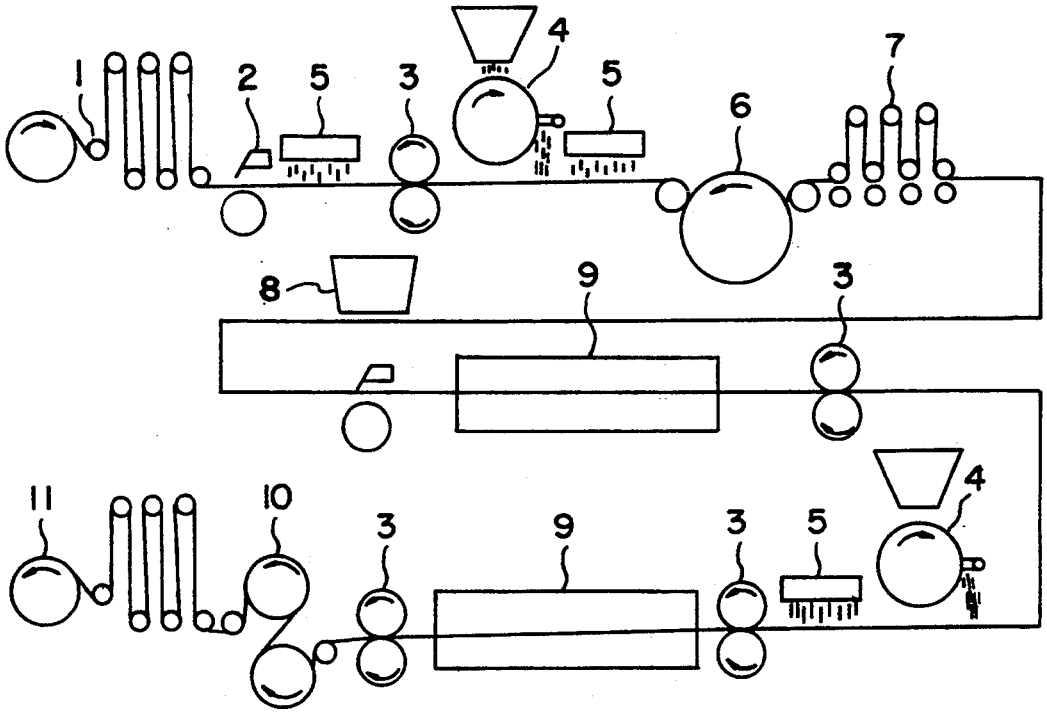
FIG. 2 illustrates a powder scattering and coating machine used in the process described in Example 5.

A heterogeneous, elastic floor covering containing EVA foam layers can be manufactured on a conventional coating machine suitable for PVC- floor coverings. Commercially available powder scattering machines are used as additional equipment. The device used is illustrated schematically in FIG. 2. The backing material (textile, glass and similar fabrics) is fed continuously to the machine by a roll take-off system 1 and storage-feed system. The corresponding coating material for sealing and smoothing the backing substrate is applied as a fixing or primer coat in a first application unit 2 by a conventional coating device (not illustrated), heated by a radiator 5 and smoothed via a smoothing device 3.

In a second application unit 4, the EVA dry blend described in either Example 2 or 3 is applied by a powder scattering machine and subsequently fused in an infrared radiator station 5. At this point, the EVA dry blend described in Examples 2 or 3 has not yet been chemically foamed or crosslinked.

The fused foam surface can additionally be smoothed and consolidated via a smoothing drum 6. A multi-colored printed design is applied to the resulting smooth foam surface by a printing machine 7 using a polymer binder printing ink. In a third application unit 8, the printed layer is covered by a transparent coating compound. The sheet structure thus obtained is heated in a drying/gelling oven 9 to 160° to 200° C., causing the EVA dry blend layer to foam (only partially in the case of structuring) and to crosslink by reaction of the peroxides present therein. Drying and reaction of the transparent cover layer occur simultaneously.

In order to improve the reverse side of the backing material and the overall resilient behavior of the floor covering structure, a foamable EVA dry blend can again be applied in a further powder scattering machine 4, as described above, and then fused, consolidated, smoothed and foamed according to the method described above with respect to the front side. A final surface treatment with a smoothing unit 3 serves to homogenize the foam surface. If required, a structured roll also can be used in the manner of an embossing unit.

The material web then is cooled in the cooling zone 10 and removed from the system to an accumulator device and roll-up system 11. If desired, an interim inspection with conversion into finished individual rolls can take place, and the rolls then fed directly to the finished goods store.

The above-described covering also can be manufactured in a batch process, in which lengths of approximately 500 meters are in each case rolled up after one or more of the above mentioned steps, stored in the interim and fed to the next processing station at a later time.

The present invention has been described with reference to preferred embodiments. Those skilled in the art recognize that variations and modifications can be made to the invention without departing from the spirit and scope thereof.

What is claimed is:

1. A process for manufacturing a latex-, PVC- and plasticizer-free plastic floor or wall covering which contains a foamed layer, comprising:

(a) scattering a powder mixture having
  (i) 100 parts by weight of a thermoplastic polymer;
  (ii) 0–100 parts by weight of inorganic filler;
  (iii) 0.5–7 parts by weight of blowing agent; and
  (iv) 0–30 parts by weight of organic additive onto a backing layer;

(b) melting the mixture at a temperature within the range of from about 70° to about 110° C.;

(c) smoothing said melted powder mixture between smoothing rolls to form a smoothed layer on the backing layer;

(d) applying at least one cover layer on said smoothing layer before step (e); and (e) foaming the smoothed layer on said backing layer at a temperature within the range of from about 120° to about 200° C., wherein said backing layer and/or said cover layer of step (d) are manufactured by the steps of:

(a') scattering a powder mixture comprising
  (i) 100 parts by weight of a thermoplastic polymer;
  (ii) 0–100 parts by weight of inorganic filler; and
  (iii) 0–30 parts by weight of organic additive;

(b') melting the mixture at a temperature within the range of from about 70° to about 110° C.; and (c') smoothing said melted powder mixture between smoothing rolls.

2. The method as claimed in claim 1, further comprising the step of printing a multicolored design onto the smoothed layer of step (c) before the cover layer of step (d) is applied.

3. A process for manufacturing a latex-, PVC- and plasticizer-free plastic floor or wall covering which contains a foamed layer, comprising:

(a) scattering a powder mixture having
  (i) 100 parts by weight of a thermoplastic polymer;
  (ii) 0–100 parts by weight of inorganic filler;
  (iii) 0.5–7 parts by weight of blowing agent; and
  (iv) 0–30 parts by weight of organic additive onto a backing layer;

(b) melting the mixture at a temperature within the range of from about 70° to about 110°. C.;

(c) smoothing said melted powder mixture between smoothing rolls to form a smoothed layer on the backing layer;

(d) printing a multicolored design on said smoothed layer of step (c);

(e) applying at least one cover layer on said printed smoothed layer of step (d); and (f) foaming the printed smoothed layer having the cover layer thereon at a temperature within the range of from about 120° to about 200° C.

* * * * *